US008340011B2

(12) United States Patent
Kenagy

(10) Patent No.: US 8,340,011 B2
(45) Date of Patent: Dec. 25, 2012

(54) METHODS AND APPARATUSES FOR INCREASING DATA TRANSMISSION EFFICIENCY IN A BROADCAST NETWORK

(75) Inventor: Jason B. Kenagy, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1003 days.

(21) Appl. No.: 12/116,799

(22) Filed: May 7, 2008

(65) Prior Publication Data

US 2009/0279468 A1 Nov. 12, 2009

(51) Int. Cl.
*H04H 20/71* (2008.01)

(52) U.S. Cl. ..... 370/312; 370/328

(58) Field of Classification Search ..... 370/312, 370/328–329, 335–338, 342, 345, 347–348, 370/432, 437, 441–444, 462, 465, 468
See application file for complete search history.

(56) References Cited

U.S. PATENT DOCUMENTS

| | | | | |
|---|---|---|---|---|
| 7,184,421 | B1 * | 2/2007 | Liu et al. | 370/338 |
| 7,864,768 | B2 * | 1/2011 | Metzler et al. | 370/390 |
| 7,885,199 | B2 * | 2/2011 | Mooney et al. | 370/252 |
| 8,145,201 | B2 * | 3/2012 | Redi | 455/420 |
| 2003/0018800 | A1 | 1/2003 | Paila et al. | |
| 2007/0133484 | A1 * | 6/2007 | Albal et al. | 370/338 |
| 2007/0168523 | A1 * | 7/2007 | Jiang et al. | 709/228 |
| 2007/0220573 | A1 * | 9/2007 | Chiussi et al. | 725/114 |
| 2008/0008147 | A1 * | 1/2008 | Nakayama | 370/338 |
| 2008/0049703 | A1 * | 2/2008 | Kneckt et al. | 370/342 |
| 2008/0069071 | A1 * | 3/2008 | Tang | 370/342 |
| 2008/0175264 | A1 * | 7/2008 | Qu et al. | 370/436 |
| 2008/0267109 | A1 * | 10/2008 | Wang et al. | 370/312 |
| 2009/0059831 | A1 * | 3/2009 | Li et al. | 370/312 |
| 2010/0042728 | A1 * | 2/2010 | Epstein et al. | 709/226 |
| 2010/0165902 | A1 * | 7/2010 | Kvernvik et al. | 370/312 |

FOREIGN PATENT DOCUMENTS

WO 2007068290 6/2007

OTHER PUBLICATIONS

International Search Report, PCT/US2009/042656, International Searching Authority, European Patent Office, Mar. 10, 2010.
Written Opinion, PCT/US2009/042656, International Searching Authority, European Patent Office, Mar. 10, 2010.

* cited by examiner

*Primary Examiner* — Chi H. Pham
*Assistant Examiner* — Kevin Mew
(74) *Attorney, Agent, or Firm* — Ryan Farr

(57) ABSTRACT

A method for increasing data transmission efficiency in a broadcast network having at least one unicast transmission link and at least one multicast transmission link to a mobile device, the method comprising: identifying a viewing trend based upon monitored viewing activity of first content data by a first plurality of users over the unicast transmission link; determining, based upon the identified trend, that a viewing audience will exceed a target threshold for second content data; and in response to the determination, broadcasting the second content data to a second plurality of users over the multicast transmission link to increase data transmission efficiency in the broadcast network. This method may also be used to promote the dissemination of useful or popular information such as service awareness as part of marketing activities.

60 Claims, 8 Drawing Sheets

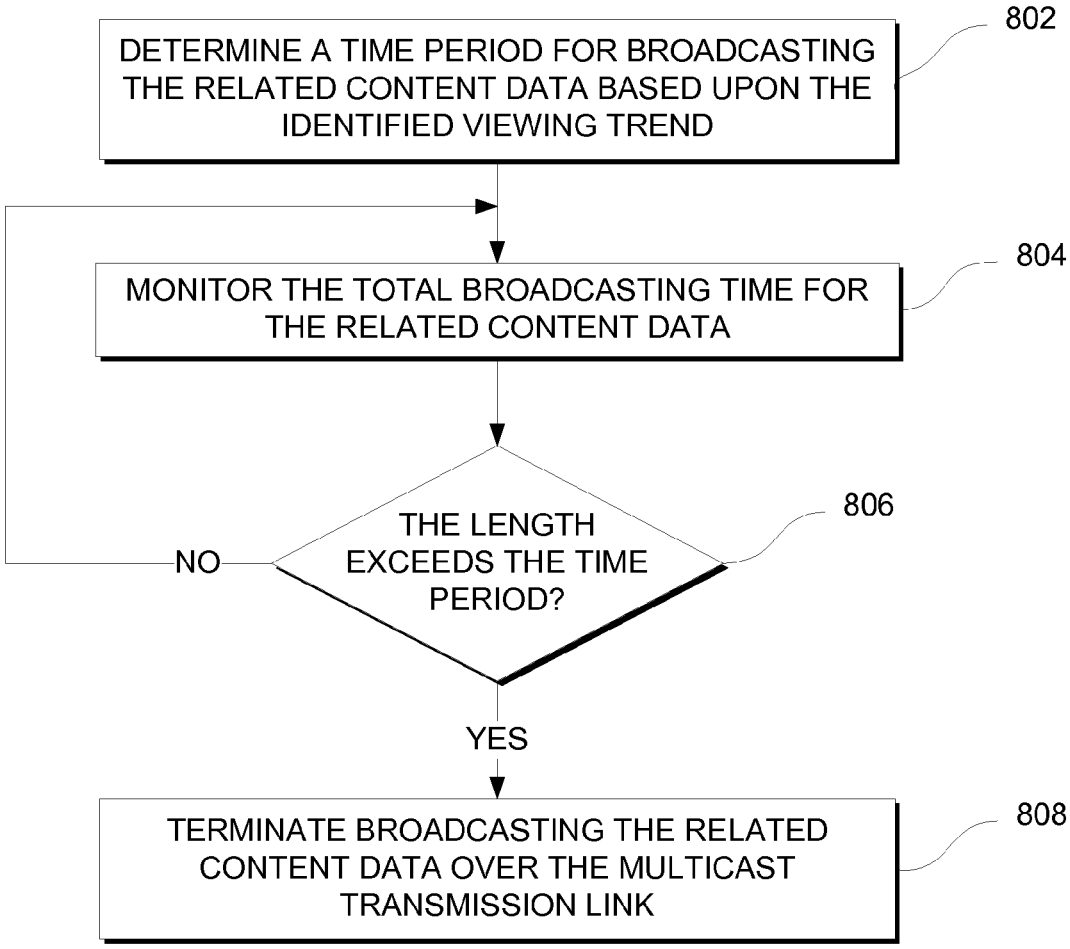
FIG. 8
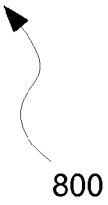

METHODS AND APPARATUSES FOR INCREASING DATA TRANSMISSION EFFICIENCY IN A BROADCAST NETWORK

TECHNICAL FIELD

This application generally relates to communications, and more specifically, to increasing data transmission efficiency in a broadcast network.

BACKGROUND

Electronic devices such as mobile telephone handsets and other mobile devices may be configured to receive broadcasts of sports, entertainment, advertisements, or other informational multimedia content items. For example, audio and/or video data may be communicated using unicast transmission links or multicast transmission links to the electronic devices. There is a need for increasing the efficiency in transmitting content data to mobile device users by monitoring and controlling the transmission links.

SUMMARY

In certain embodiments, a method for increasing data transmission efficiency in a broadcast network having at least one unicast transmission link and at least one multicast transmission link to a mobile device comprises: identifying a viewing trend based upon monitored viewing activity of first content data by a first plurality of users over the unicast transmission link; determining, based upon the identified trend, that a viewing audience will exceed a target threshold for second content data; and in response to the determination, broadcasting the second content data to a second plurality of users over the multicast transmission link to increase data transmission efficiency in the broadcast network.

In certain embodiments, an apparatus for increasing data transmission efficiency in a broadcast network having at least one unicast transmission link and at least one multicast transmission link to a mobile device comprises a processor configured to: identify a viewing trend based upon monitored viewing activity of first content data by a first plurality of users over the unicast transmission link, and determine, based upon the identified trend, that a viewing audience will exceed a target threshold for second content data. The apparatus also comprises a transmitter configured to, in response to the determination, broadcast the second content data to a second plurality of users over the multicast transmission link to increase data transmission efficiency in the broadcast network.

In certain embodiments, an apparatus for increasing data transmission efficiency in a broadcast network having at least one unicast transmission link and at least one multicast transmission link to a mobile device comprises: means for identifying a viewing trend based upon monitored viewing activity of first content data by a first plurality of users over the unicast transmission link; means for determining, based upon the identified trend, that a viewing audience will exceed a target threshold for second content data; and means for, in response to the determination, broadcasting the second content data to a second plurality of users over the multicast transmission link to increase data transmission efficiency in the broadcast network.

Methods and apparatuses of the disclosure each have several embodiments. No single one of the embodiments is solely responsible for its desirable attributes. Without limiting the scope of this invention, for example, as expressed by the claims which follow, its more prominent features will now be discussed briefly. After considering this discussion, and particularly after reading the section entitled "Detailed Description" one will understand how the features of this invention provide advantages that include allowing a content provider to transmit content data to more mobile devices in more efficient ways.

BRIEF DESCRIPTION OF THE DRAWINGS

FIG. 8 illustrates a further variation to the flowchart as illustrated in FIG. 5.

DETAILED DESCRIPTION

The following detailed description is directed to certain embodiments of the disclosure. However, the invention can be embodied in a multitude of different ways, for example, as defined and covered by the claims. It should be apparent that the embodiments herein may be embodied in a wide variety of forms and that any specific structure, function, or both being disclosed herein is merely representative. Based on the teachings herein one skilled in the art should appreciate that an embodiment disclosed herein may be implemented independently of any other embodiments and that two or more of these embodiments may be combined in various ways. For example, an apparatus may be implemented or a method may be practiced using any number of the embodiments set forth herein. In addition, such an apparatus may be implemented or such a method may be practiced using other structure, functionality, or structure and functionality in addition to or other than one or more of the embodiments set forth herein.

One embodiment comprises a system that monitors viewing activity with respect to the content data that are being unicast and identifies a viewing trend. If the viewing trend indicates viewing activity will exceed a target threshold, the system multicasts or broadcasts the content data or related content data to a plurality of mobile devices.

Figure 1:
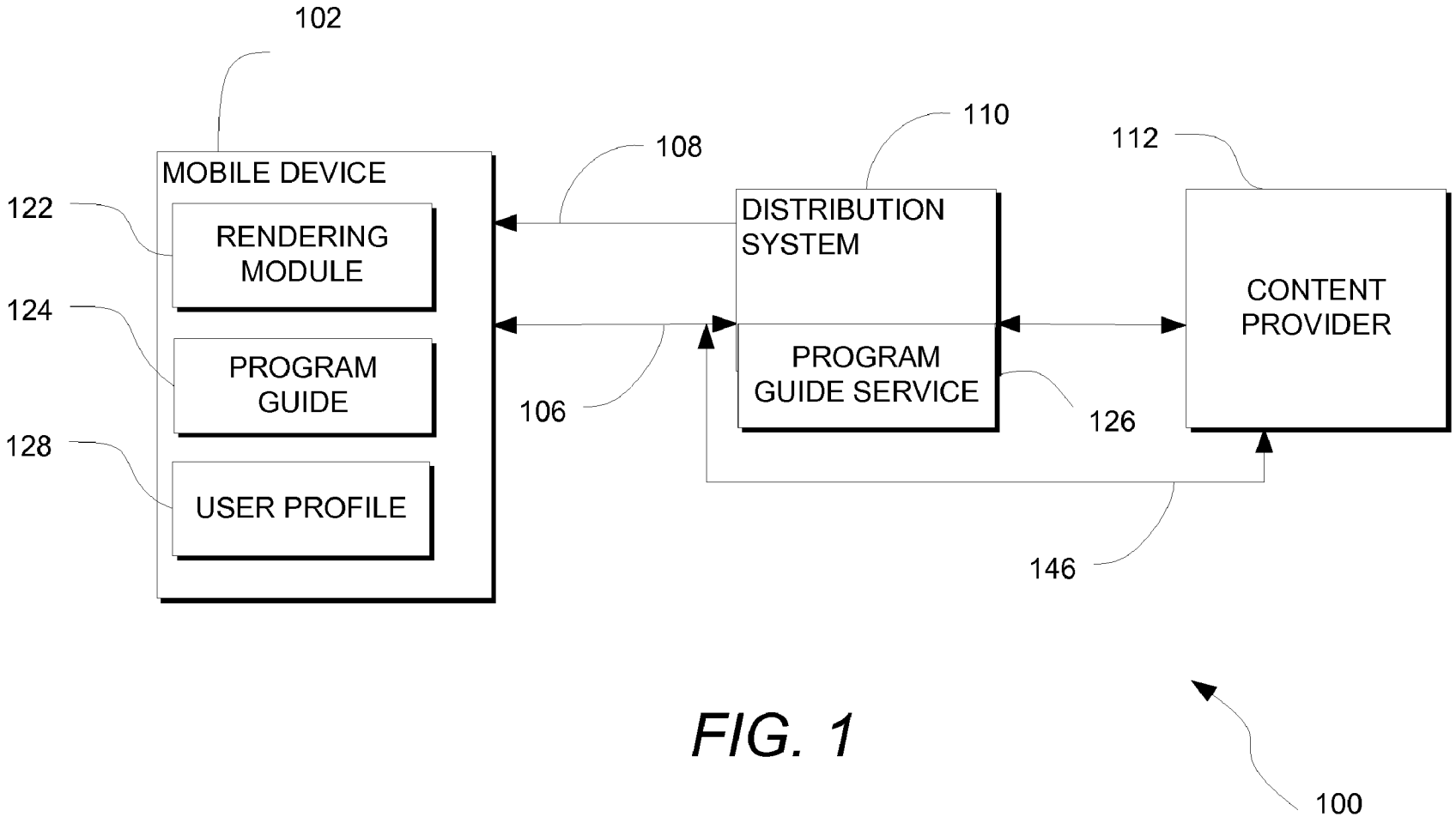
FIG. 1 is a block diagram illustrating an example of a system for providing broadcast content items to mobile devices.

FIG. 1 is a block diagram illustrating an example of a system 100 for providing broadcast content items to mobile devices 102 from one or more content providers 112 using a distribution system 110. While a single mobile device 102 is shown in FIG. 1, the system 100 may be configured to use any number of mobile devices 102. The system 100 also includes a distribution system 110 and a content provider 112. The distribution system 110 may receive data representing a multimedia content item from the content provider 112. The multimedia content items may be communicated over a wired or wireless content item communication link 108. The advertisements may also be communicated over a separate wired or wireless communication link that is different from the wired or wireless content item communication link 108. In one embodiment, the communications link 108 is a high speed or broadband link. In one embodiment, the content provider 112 communicates content directly over a second wireless or wired link 146 to the mobile device 102, bypassing the distribution system 110. It is to be recognized that in other embodiments multiple content providers 112 may provide content items using multiple distribution systems 110 to the mobile devices 102.

In the exemplary system 100 of FIG. 1, the content item communication link 108 is illustrated as a unidirectional network. However, the content item communication link 108 may also be a fully symmetric bi-directional network. The content item communication link 108 may comprise one or more wired and/or wireless links, including one or more of a Ethernet, telephone (e.g., POTS), cable, power-line, and fiber optic systems, and/or a wireless system comprising one or more of a code division multiple access (CDMA or CDMA2000) communication system, a frequency division multiple access (FDMA) system, a time division multiple access (TDMA) system such as GSM/GPRS (General Packet Radio Service)/EDGE (enhanced data GSM environment), a TETRA (Terrestrial Trunked Radio) mobile telephone system, a wideband code division multiple access (WCDMA) system, Mobile-Originated Short Message Service (MO-SMS) system, a 3 G data network system, a high data rate (1xEV-DO or 1xEV-DO Gold Multicast) system, an IEEE 802.11 system, a MediaFLO system, a DMB system, an orthogonal frequency division multiple access (OFDM) system, or a DVB-H system.

In the exemplary system 100, the mobile device 102 may also be configured to communicate on a third communication link 106 which may comprise any of the networks described above with reference to the link 108. In one embodiment, the communication link 106 is a two way communication link such as is illustrated in the exemplary system 100. The communication link 106 may be used in communication between the mobile device 102 and the broadcast center or distribution system 110 and/or the content provider 112. In one embodiment, the distribution system 110 is a broadcast center. The third communication link 106 may be a wireless network configured to communicate voice traffic and/or data traffic. The communication link 106 may communicate program guide and other data between the distribution system 110 and the mobile device 102.

The mobile device 102 includes a rendering module 122 configured to render the multimedia content items received over the content item communication link 108. The rendering module 122 may include analog and/or digital technologies. The rendering module 122 may include one or more multimedia signal processing systems, such as video encoders/decoders, using encoding/decoding methods based on international standards such as MPEG-x and H.26x standards. Such encoding/decoding methods generally are directed towards compressing the multimedia data for transmission and/or storage.

In addition to communicating content items to the mobile device 102, the distribution system 110 may also include a program guide service 126. The program guide service 126 receives program schedule and content related data from the content provider 112 and/or other sources and communicates data representing an electronic programming guide (EPG) 124 to the mobile device 102. The EPG 124 may include data related to the broadcast schedule of multiple content items available to be received over the content item communication link 108. The EPG data may include titles of content items, start and end times, category classification of content items (e.g., sports, movies, comedy, etc.), quality ratings, adult content ratings, etc. The EPG 124 may also be communicated to the mobile device 102 over the content item communication link 108 and stored in the mobile device 102.

Mobile devices such as mobile handsets and music/video players are often used by a particular user. Therefore, the mobile device 102 may also include a user profile 128. For example, the user profile 128 may be configured to store information indicative of content items selected for viewing by a user. In one embodiment, the user profile 128 stores data indicative of one or more content items that will be, or have been, viewed, recorded, or otherwise accessed by the user. The profile may be updated based on data indicative of accessed content items, a category associated with the accessed content items, an elapsed viewing time of the accessed content items, and a channel associated with the content items.

Figure 2:
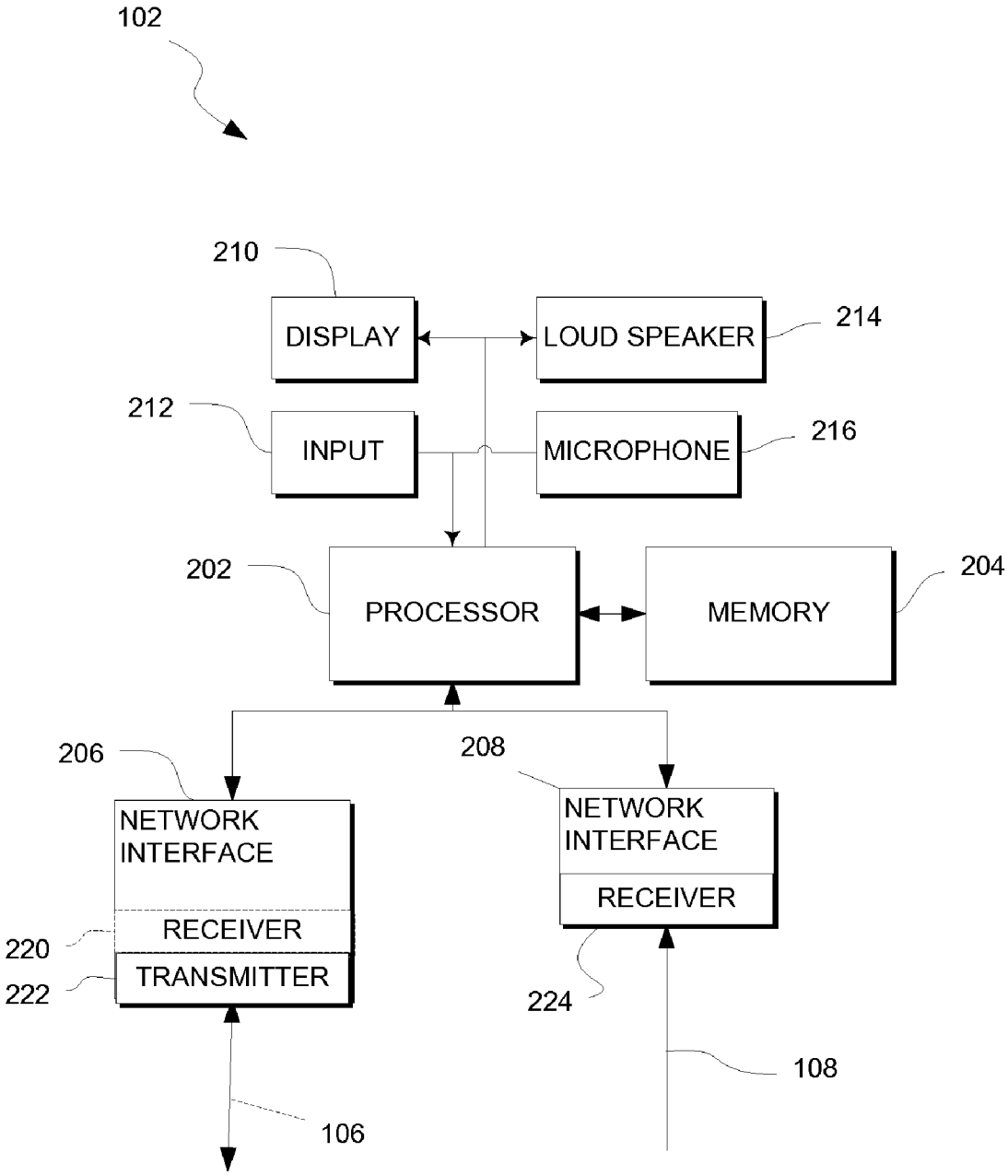
FIG. 2 is a block diagram illustrating an example of a mobile device such as illustrated in FIG. 1.

FIG. 2 is a block diagram illustrating an example of the mobile device 102 such as illustrated in FIG. 1. The mobile device 102 includes a processor 202 that may be in communication with a memory (or storage device) 204 and a network interface 208 that communicates over the content item communication link 108. The network interface 208 includes a receiver 224 configured to receive the unidirectional content item communication link 108. The network interface 208 and the receiver 224 may receive signals according to wired technologies which are the same as or similar to those for the content item communication link 108.

The mobile device 102 may include an optional second network interface 206 for communicating using the bi-directional communication link 106. The network interface 206 may include any suitable antenna (not shown), a receiver 220, and a transmitter 222 so that the mobile device 102 can communicate with one or more devices over the bi-directional communication link 106.

The mobile device 102 may also includes one or more of a display 210, a user input device 212 such as a key, touch screen, or other suitable tactile input device, a loudspeaker 214 comprising a transducer adapted to provide audible output based on a signal received over the communication link 106 and/or a microphone 216 comprising a transducer adapted to provide audible input of a signal that may be transmitted over the communication links 106 or 108.

The mobile device 102 may comprise at least one of a mobile handset, a personal digital assistant, a laptop computer, a headset, a vehicle hands free device, or any other electronic device. For example, one or more embodiments taught herein may be incorporated into a phone (e.g., a cellular phone), a personal data assistant ("PDA"), an entertainment device (e.g., a music or video device), a headset (e.g., headphones, an earpiece, etc.), a microphone, or any other suitable device.

The components described herein may be implemented in a variety of ways. Referring to FIG. 2, the mobile device 102 may be represented as a series of interrelated functional blocks that may represent functions implemented by, for example the processor 202, software (not shown), some combination thereof, or in some other manner as taught herein. For example, the processor 202 may facilitate user input using the input devices 212. Further, the transmitter 222 may comprise a processor (not shown in FIG. 2) that provides various functionalities relating to transmitting information, for example, to another mobile device 102, or to an email address of a user. Also, the receivers 220 or 224 may comprise a processor (not shown in FIG. 2) to provide various functions relating to receiving information, in example, from another mobile device 102.

In some embodiments, the device or apparatus 102 comprises an integrated circuit ("IC"). Thus, the integrated circuit may comprise one or more processors that provide the functionality of the processor components illustrated in FIG. 2. For example, in some embodiments a single processor implements the functionality of the illustrated processor components, while in other embodiments more than one processor implements the functionality of the illustrated processor components. In addition, in some embodiments the integrated circuit comprises other types of components that implement some or all of the functionality of the illustrated processor components.

Any illustrative logical blocks, modules, and circuits described in connection with the embodiments disclosed herein may be implemented within or performed by an integrated circuit, an access terminal, or an access point. The IC may comprise a general purpose processor, a digital signal processor (DSP), an application specific integrated circuit (ASIC), a field programmable gate array (FPGA) or other programmable logic device, discrete gate or transistor logic, discrete hardware components, electrical components, optical components, mechanical components, or any combination thereof designed to perform the functions described herein, and may execute codes or instructions that reside within the IC, outside of the IC, or both. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

Those skilled in the art will recognize that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of this disclosure.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium may be coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

Figure 3:
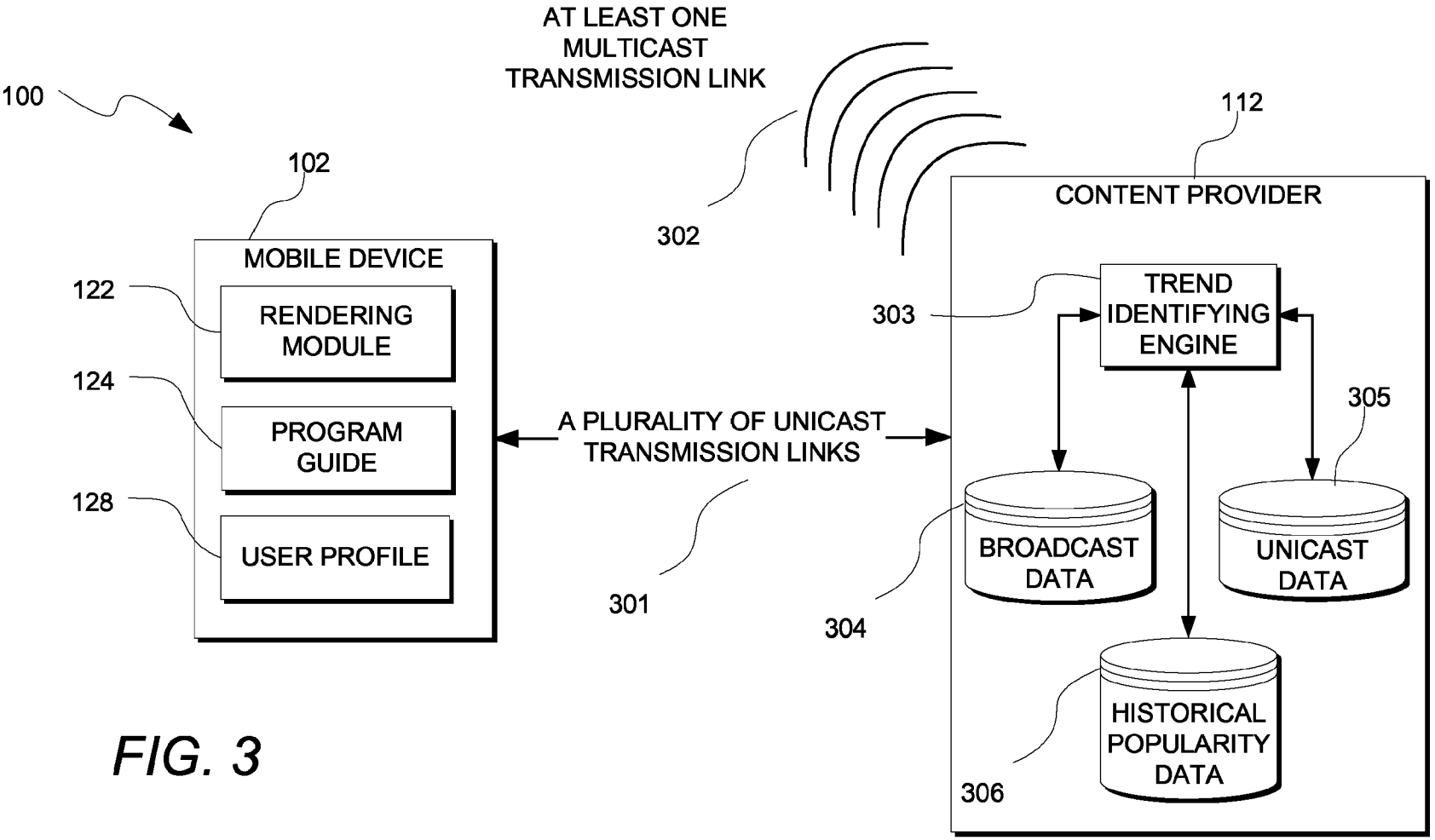
FIG. 3 is a block diagram illustrating a portion of the system of FIG. 1 in more detail.

FIG. 3 is a block diagram further illustrating the system 100 for providing content items to mobile devices 102. In FIG. 3, like parts are numbered similarly with respect to previous figures. As illustrated in FIG. 3, the content provider 112 transmits content data to a mobile device 102 over a unicast transmission link 301. The content provider 112 may also transmit content data to a group of mobile devices 102 over a multicast transmission link 302. The unicast transmission link 301 and the multicast transmission link 302 are implemented by utilizing the distribution system 110, the communication link 108, and/or the wireless or wired link 146 as illustrated in FIG. 1.

The system 100 may include a plurality of unicast transmission links 301, which are directed to the same or different mobile devices 102. The system 100 may also include a plurality of multicast transmission links 302, which are directed to the same or different groups of mobile devices 102. Depending on the embodiment, the number of unicast transmission links 301 to the mobile device(s) 102 may vary depending on a number of factors. Examples of these factors include the attributes of the content data, the number of the mobile devices being served by the content provider 112, the bandwidth of each communication link, the total viewing time for the transmitted content data, the interaction between mobile devices and the content provider 112, etc.

The mobile device 102 may individually request content data from the content provider 112 via a unicast transmission link 301. More than one unicast transmission link 301 may be established between the content provider 112 and a single mobile device 102 if the same mobile device 102 requests more pieces of content data from various sources via the content provider 112. Consequently, there is a possibility that the overall performance of the system 100, especially the overall performance of the content provider 112, may deteriorate when a large, increasing number of unicast transmission links 301 are requested and managed by the system 100.

For example, the number of unicast transmission links 301 may vary according to the popularity of the content data. Some categories, or genres, of content data might be more popular than other categories or genres. Examples of popular content data include certain software updates, celebrity bloopers, weather forecasts, sports highlights, special events, etc.

The number of available unicast transmission links 301 may vary according to historical request information for content data. For example, the number of links 301 may be increased by previous high demand for the same, similar or related content data.

In one embodiment, the system 100 determines the number of available links 301 based on popularity data and/or historical data. As illustrated in FIG. 3, the content provider 112 in one such embodiment comprises a trend identifying engine 303 configured to increase data transmission efficiency in a broadcast network. The trend identifying engine 303 may be implemented as software code executed by a processor used to provide other functions of the content provider 112, or on any other processor, including one or more additional server computers associated with the content provider 112. In one embodiment, the trend identifying engine 303 is configured to identify a viewing trend based upon the monitored viewing activity of content data (e.g., the first content data) being viewed by a plurality of users (e.g., a first plurality of users) over a plurality of unicast transmission links (e.g., a first plurality of unicast transmission links) 301. In one embodiment, the trend identifying engine 303 is also configured to determine, based upon the above identified trend, whether a viewing audience will exceed a given target threshold, for example, 1,000,000 users, for related content data (e.g., the second content data).

Figure 4:
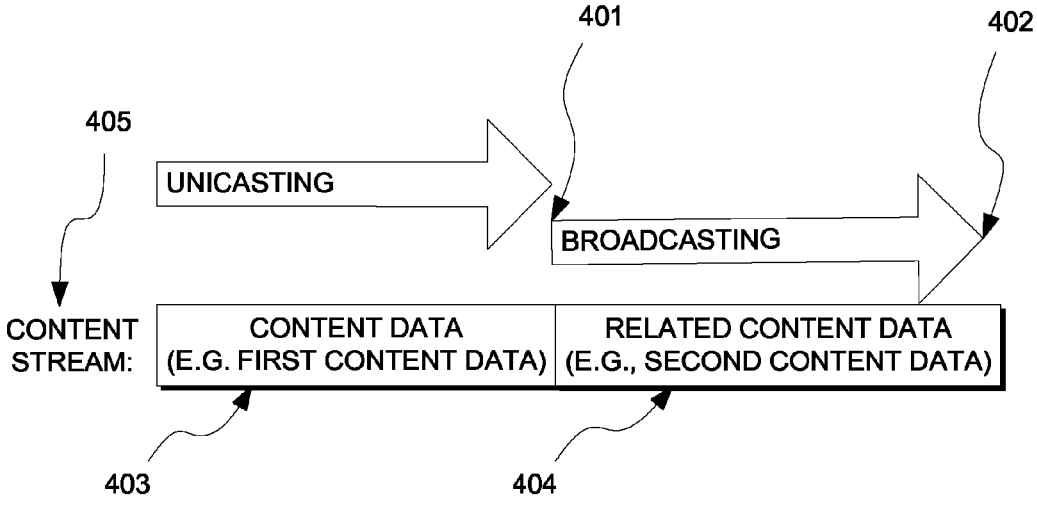
FIG. 4 illustrates an example of the content data that may be transmitted in the broadcast network as illustrated in FIG. 1 or 3.

In one embodiment, the content data and the related content data may be provided by one or more points of origin, sources, producers, licenses, attributes, formats, encoding schemes, etc. Further, the content data and the related content data may belong to the same content stream as illustrated in FIG. 4, below. In other examples, the content data and the related content data may belong to different content streams.

In FIG. 3, if the trend identifying engine 303 determines that the viewing audience will exceed a given target threshold for the related content data, the trend identifying engine 303 is further configured to broadcast the related content data to a plurality of users (e.g., a second plurality of users) over multicast transmission link 302 to increase data transmission efficiency in the broadcast network such as system 100 by directing a single transmission to multiple users.

The viewing activity of the content data may be monitored in many different ways. In one embodiment, the number of unicast transmission links 301 is monitored, and the trend identifying engine 303 is additionally configured to determine whether the number of unicast transmission links 301 exceeds a second threshold, for example, 500,000. Here, the unicast transmission links are being used by the transmitter to transmit the content data to the first plurality of users. In another embodiment, the total viewing time of the content data being transmitted over unicast transmission links 301 is monitored, and the trend identifying engine 303 is additionally configured to determine whether the total viewing time of the content data exceeds a third threshold, for example, an hour.

In one embodiment, during the above monitoring and identifying processes, the trend identifying engine 303 may access relevant databases or data stores, such as the broadcast data storage 304 and the unicast data storage 305, as well as other system resources, including additional resources not illustrated in FIG. 3. The broadcast data storage 304 and the unicast data storage 305 are provided to the transmitter to serve as queues in transmitting either the unicast data or the broadcast data to users of mobile devices 102.

In yet another embodiment, the trend identifying engine 303 is additionally configured to predict the trend based on historical popularity data regarding the content data and/or the related content data. The historical popularity data may be stored in the historical popularity data storage 306. In one example, the historical popularity data includes historical request information for content data. The trend engine 303 employs such historical request information to predict demand for the same, similar or related content data. For instance, if there has been historically high demand for video clips featuring a certain celebrity, the trend identifying engine 303 may predict high demand for a latest video clip which is related to the earlier video clip by featuring the same celebrity.

In another example, the historical popularity data includes data collected from other sources external to the system 100. In order to collect sufficient historical popularity data, the trend identifying engine 303 may be further configured to collect additional historical popularity data from external sources. The historical popularity data may be collected from various sources such as the Internet, news mentions, blogging data. For instance, if there are many news mentions regarding a current event, the trend identifying engine 303 may be configured to predict high demand for video clips or other content data related to this current event.

The trend identifying engine 303 may also be configured to identify whether the related content data is associated with a live event and predict demand for content data relating to such a live event. The trend identifying engine 303 may also be additionally configured to compare at least one attribute of the content data and the related content data. An example of the attribute is the genre, which, for example, includes at least one of sports, news, entertainment, and education.

In one embodiment, the content provider 112 terminates broadcasting the related content data over multicast transmission link 302 if the related content data has been broadcast for a period of time. The period of time is determined based on identified trends, such as for example by the trend identifying engine 303. The content provider 112 may also terminate broadcasting the related content data over multicast transmission link 302 based upon the monitored viewing activity of the related content data. For example, if the content provider 112 detects that a large number of the mobile devices 102 to which the related content data are transmitted over multicast transmission link 302 have not interacted with the content provider 112 through any available techniques supported by the system 100 for a threshold length of time, then the content provider 112 terminates broadcasting the related content data to these mobile devices.

FIG. 4 illustrates an example process related to the content data discussed above with reference to FIG. 3. As illustrated in FIG. 4, the content data 403 and the related content data 404 may belong to the same content stream 405. Initially, the content provider 112 transmits the content data 403 to a first plurality of the mobile devices 102 over a plurality of unicast connections. Once the processor determines that a viewing audience exceeds a target threshold for the related content data 404, the transmitter broadcasts the related content data 404, beginning approximately at time 401, to a second plurality of mobile devices over a single broadcast channel. In one embodiment, the second plurality of mobile devices includes the first plurality of mobile devices. At a determined time 402, the content provider 112 terminates broadcasting the related content data. After time 402, the content provider 112 may also continue transmitting to the first plurality of mobile devices a portion of the content that follows the content data in the same content stream. The content provider 112 may transmit the content data and the related content data via different content streams.

Figure 5:
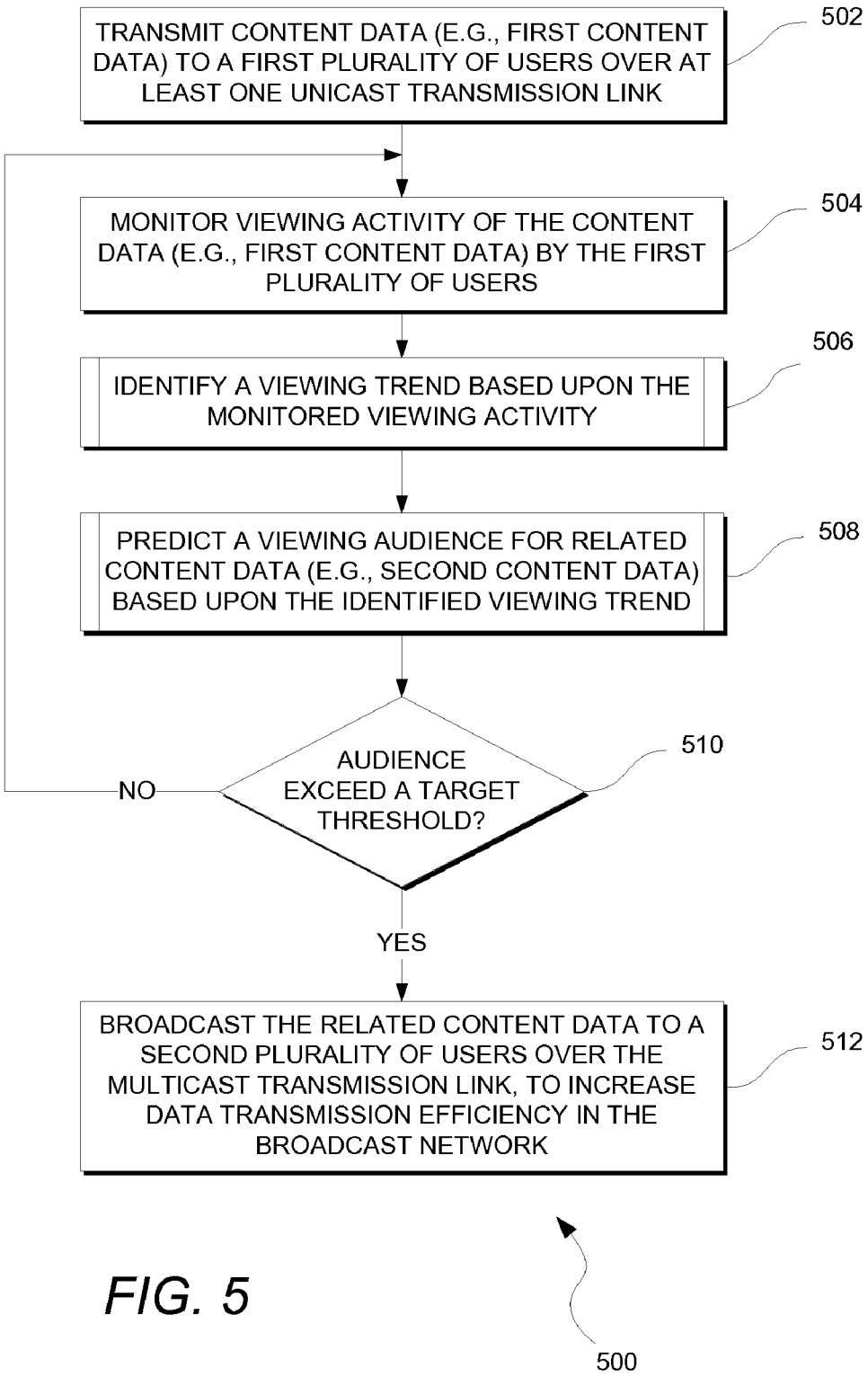
FIG. 5 is a flowchart illustrating an example of a method for increasing data transmission efficiency in the broadcast network as illustrated in FIG. 1 or 3.

FIG. 5 is a flowchart illustrating an example of a method 500 for increasing the efficiency of transmitting content data to one or more content reception and rendering devices, such as the mobile device 102, within a broadcast network, such as the system 100. At block 502, the content provider 112 transmits the content data (e.g., the first content data) to a first plurality of users over a plurality of unicast transmission links, such as unicast transmission links 301. Each user's mobile device 102 receives the content data on its corresponding unicast transmission link 301. In one embodiment, a new user may request the content data from the content provider 112 at any time subsequent to initial offering. Thus, the content provider 112 may provide a varying number of unicast transmission links 301.

At block 504, the content provider 112 monitors the viewing activity with respect to the content data by the first plurality of users. As discussed above with respect to FIG. 3, the viewing activity with respect to the content data may be monitored in many different ways. In one embodiment, the content provider 112 monitors the number of unicast transmission links 301. In another embodiment, the content provider 112 monitors the total viewing time of the content data being transmitted over unicast transmission links 301.

Next, at block 506, the content provider 112 identifies a viewing trend based on the viewing activity monitored at block 504. At block 508, the content provider 112, e.g., via the trend identifying engine 303, predicts a viewing audience for the related content data (e.g., the second content data) based upon the viewing trend identified at block 504.

At block 510, the content provider 112 determines whether the audience exceed a given target threshold, for example, 1,000,000 users. If the determination result of block 510 is "No," method 500 returns to block 504. Otherwise, method 500 proceeds to block 512. At block 512, the content provider 112 broadcasts the related content data to a second plurality of users over multicast transmission link 302, to increase data transmission efficiency in the system 100.

As stated above with respect to FIG. 3, the trend identifying engine 303 may be configured to identify viewing trends and predict viewing audience based on popularity data and historical request information for the content data and/or the related content data. Several embodiments are illustrated in more detail below with reference to FIGS. 5A, 5B and 6.

Figure 6A:
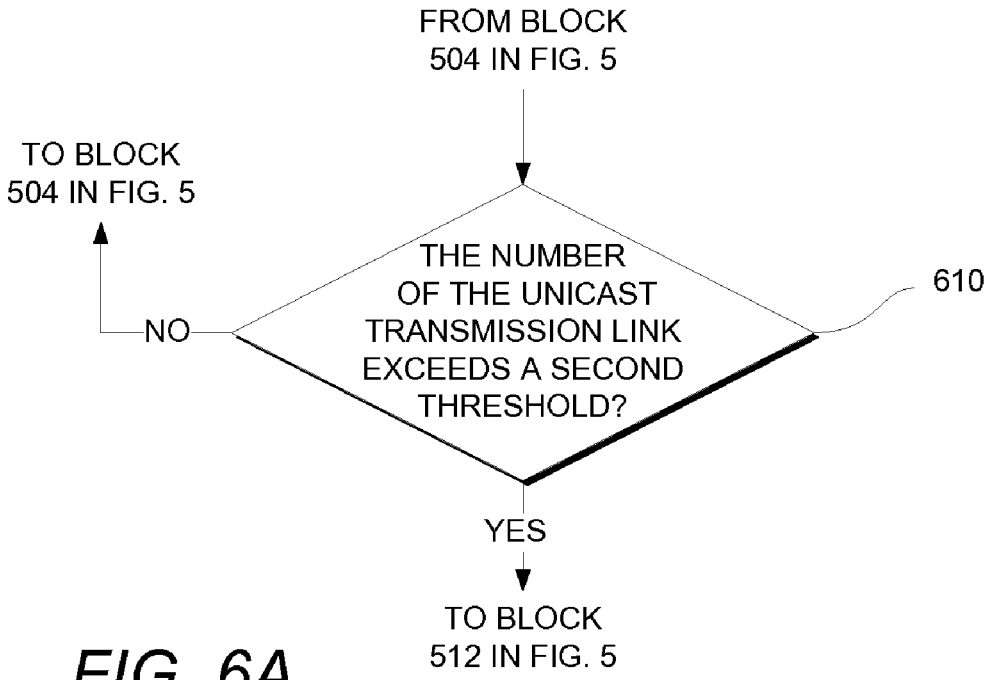
FIGS. 6A and 6B illustrate two variations to the flowchart as illustrated in FIG. 5.
Figure 6B:
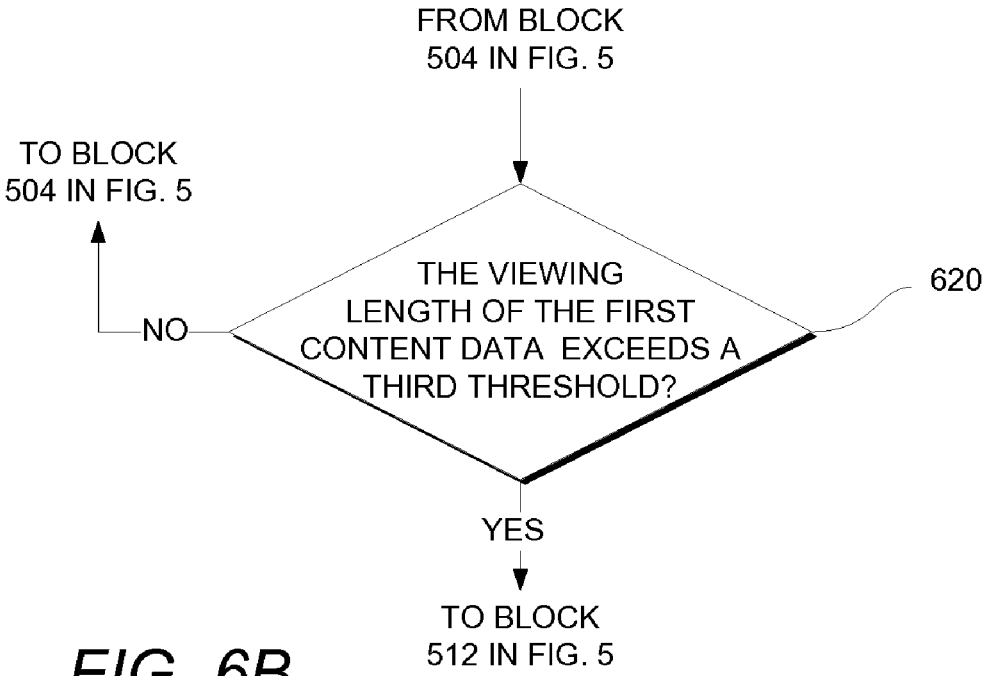

FIGS. 6A and 6B illustrate two embodiments of the method 500 illustrated in FIG. 5. In the embodiment as illustrated in FIG. 6A, the number of unicast transmission links 301 is monitored at block 504. Proceeding to block 610 in FIG. 6A, the content provider 112 determines whether the number of unicast transmission links 301 exceeds a second given threshold, for example, 500,000. If the determination result of block 610 is "No," method 500 returns to block 504 in FIG. 5. Otherwise, method 500 proceeds to block 512 in FIG. 5.

In another embodiment as illustrated in FIG. 6B, the total viewing time of the content data being transmitted over unicast transmission links 301 is monitored at block 504 in FIG. 5. Proceeding to block 620 in FIG. 6B, the content provider 112 determines whether the total viewing time of the content data being transmitted over unicast transmission links 301 exceeds a third given threshold, for example, an hour. If the determination result of block 620 is "No," method 500 returns to block 504 in FIG. 5. Otherwise, method 500 proceeds to block 512 in FIG. 5.

Figure 7:
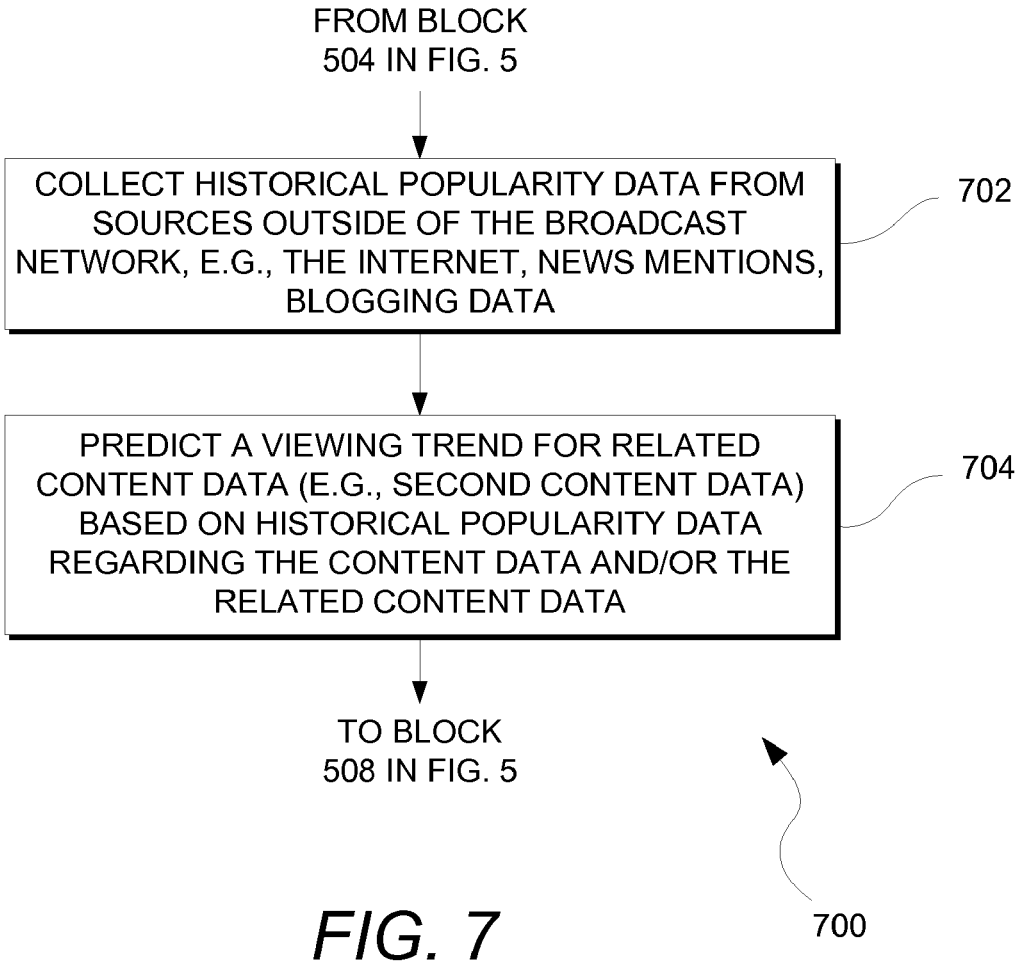
FIG. 7 illustrates another variation to the flowchart as illustrated in FIG. 5.

FIG. 7 illustrates another embodiment of the method 500. In this embodiment, historical popularity data are collected in advance and utilized to predict the viewing trend for the related content data. Proceeding from block 504 in FIG. 5 to block 702 in FIG. 7, the content provider 112 collects historical popularity data from one or more sources internal or external to the broadcast network such as from system 100. Examples of such sources are the Internet, news mentions, and blogging data. The collection of historical popularity data may also be conducted independently, prior to, or in parallel with, the execution of method 500. The collection of historical popularity data may also be implemented as an ongoing process.

Once historical popularity data have been collected, method 500 proceeds to block 704 in which the content provider 112, and in particular, the trend identifying engine 303, predicts a viewing trend for the related content data based upon the collected historical popularity data regarding the content data and/or the related content data. Next, method 500 proceeds to block 508 in FIG. 5.

The monitoring, identifying and determining processes in the embodiments as illustrated in FIGS. 6A, 6B and 7 may replace or supplement the whole or part of the processes in blocks 504, 506, 508 and 510 in FIG. 5. The processes as illustrated in FIGS. 6A, 6B and 7 may also be executed in cooperation with the processes as illustrated in FIG. 5. In one of the various embodiments, the content provider 112 identifies whether the related content data comprises a live event. If the content provider 112 identifies that the related content data is a live event, the content provider may determine that an audience for the related content data will exceed a given target threshold since users are generally more interested in live events than non-live events. In another embodiment, the content provider 112 compares at least one attribute of the content data with that of the related content data. An example of the attribute is the genre, which, for example, includes at least one of sports, news, entertainment and education.

The broadcasting process in block 512 of FIG. 5 can also be monitored and controlled to provide more efficient use of network bandwidth. One embodiment of monitoring and controlling the broadcasting process is illustrated in FIG. 8. In FIG. 8, method 800 starts from block 802. At block 802, the content provider 112 determines a time period for broadcasting the related content data based upon the viewing trend identified in block 406 of FIG. 5.

At block 804, the content provider 112 monitors the total broadcasting time for the related content data. At block 806, the content provider 112 determines whether the monitored time in block 804 exceeds the time period determined in block 802. If the determination result of block 806 is "No," method 800 returns to block 804 in which the content provider 112 continues monitoring the total broadcasting time for the related content data. If the determination result of block 706 is "Yes," method 800 proceeds to block 808 in which the content provider 112 terminates broadcasting the related content data over the multicast transmission link.

In the embodiments as illustrated in FIGS. 5, 6A, 6B, 7 and 8, the content data and the related content data can be transmitted in the same content stream, as illustrated in FIG. 4. The different content data can also be transmitted via different content streams. Various examples of the content data and the related content data have been described with respect to FIG. 3.

In all above embodiments, the apparatuses and methods can also monitor actual viewing activities with respect to the broadcast content data and move the broadcast content data back to the unicast transmission links when certain conditions are met. Alternatively, the broadcast queue, for example, in the memory of the content provider 112, or in the broadcast data storage 304, can simply be overwritten by the new content data determined fit for broadcast so as to move items that are no longer in high demand away from the broadcast queue.

The apparatuses and methods described herein may be used to increase the data transmission efficiency in a broadcast network by "transitioning" a plurality of unicast transmission links into a single multicast transmission link, e.g., in a broadcast system such as that provided by MediaFLO USA of San Diego, Calif. The apparatuses and methods described herein may also be used to promote the dissemination of useful or popular information such as service awareness as part of marketing activities. Mobile network carriers may advertise several services through the apparatuses and methods described herein, determine the most popular service and then broadcast it to additional mobile devices. Another example where the system increases efficiency is with respect to downloading ring tones to mobile devices. If the content provider 112 determines that a certain ring tone has been downloaded by a threshold number of mobile device users, the mobile network carrier can simply broadcast the same ring tone to additional mobile devices.

While the above detailed description has shown, described, and pointed out novel features of the invention as applied to various embodiments, it will be understood that various omissions, substitutions, and changes in the form and details of the device or process illustrated may be made by those skilled in the art without departing from the scope of this disclosure. As will be recognized, the invention may be embodied within a form that does not provide all of the features and benefits set forth herein, as some features may be used or practiced separately from others. The scope of this disclosure is defined by the appended claims, the foregoing description, or both. All changes which come within the meaning and range of equivalency of the claims are to be embraced within their scope.

The invention claimed is:

1. A method for increasing data transmission efficiency in a network, the method comprising:

identifying a viewing trend based upon monitored viewing activity of first content data by a first plurality of users over a unicast transmission link, wherein identifying the viewing trend comprises determining whether a total viewing time for the first content data being transmitted over the unicast transmission link satisfies a first threshold;

determining, based upon the identified trend, that a viewing audience will satisfy a second threshold for second content data; and in response to the determination, broadcasting the second content data to a second plurality of users over a multicast transmission link.

2. The method of claim 1, wherein identifying the trend further comprises determining whether a number of the unicast transmission links exceeds a third threshold, the unicast transmission links being used to transmit the first content data.

3. The method of claim 1, wherein identifying the trend further comprises predicting the trend based on historical popularity data regarding the first content data.

4. The method of claim 3, additionally comprising collecting the historical popularity data from sources outside of a broadcast network that includes the multicast transmission link.

5. The method of claim 4, wherein the sources include at least one of the Internet, news mentions and blogging data.

6. The method of claim 1, wherein determining comprises identifying whether the second content data comprises a live event.

7. The method of claim 1, wherein determining comprises comparing at least one attribute of the first content data and the second content data.

8. The method of claim 7, wherein the attribute comprises a genre.

9. The method of claim 8, wherein the genre includes at least one of sports, news, entertainment and education.

10. The method of claim 1, additionally comprising terminating broadcasting the second content data over the multicast transmission link if the second content data have been broadcast for a period of time, the period of time being determined based on the identified trend.

11. The method of claim 1, additionally comprising terminating broadcasting the second content data over the multicast transmission link based upon monitored viewing activity of the second content data.

12. The method of claim 1, wherein the first content data and the second content data are transmitted via the same content stream.

13. The method of claim 12, additionally comprising continuing to transmit to the first plurality of users a portion of the content that follows the first content data in the same content stream.

14. The method of claim 1, wherein the first content data and the second content data are transmitted via different content streams.

15. The method of claim 14, wherein the second plurality of users include the first plurality of users.

16. An apparatus for increasing data transmission efficiency in a network, the apparatus comprising:

a processor configured to:

identify a viewing trend based upon monitored viewing activity of first content data by a first plurality of users over a unicast transmission link, wherein the processor is configured to identify the viewing trend at least by determining whether a total viewing time for the first content data being transmitted over the unicast transmission link satisfies a first threshold; and determine, based upon the identified trend, that a viewing audience will satisfy a second threshold for second content data;

a transmitter configured to, in response to the determination, broadcast the second content data to a second plurality of users over a multicast transmission link.

17. The apparatus of claim 16, wherein the processor is additionally configured to determine whether a number of the unicast transmission links exceeds a third threshold, the unicast transmission links being used to transmit the first content data.

18. The apparatus of claim 17, wherein the processor is additionally configured to predict the trend based on historical popularity data regarding the first content data.

19. The apparatus of claim 18, comprising a device for collecting the historical popularity data from sources outside of a broadcast network that includes the multicast transmission link.

20. The apparatus of claim 19, wherein the sources include at least one of the Internet, news mentions and blogging data.

21. The apparatus of claim 16, wherein the processor is additionally configured to identify whether the second content data comprises a live event.

22. The apparatus of claim 16, wherein the processor is additionally configured to compare at least one attribute of the first content data and the second content data.

23. The apparatus of claim 22, wherein the attribute comprises a genre.

24. The apparatus of claim 23, wherein the genre includes at least one of sports, news, entertainment and education.

25. The apparatus of claim 16, wherein the transmitter terminates broadcasting the second content data over the multicast transmission link if the second content data have been broadcast for a period of time, the period of time being determined based on the identified trend.

26. The apparatus of claim 16, wherein the transmitter terminates broadcasting the second content data over the multicast transmission link based upon monitored viewing activity of the second content data.

27. The apparatus of claim 16, wherein the transmitter transmits the first content data and the second content data via the same content stream.

28. The apparatus of claim 27, wherein the transmitter continues to transmit to the first plurality of users a portion of the content that follows the first content data in the same content stream.

29. The apparatus of claim 16, wherein the transmitter transmits the first content data and the second content data via different content streams.

30. The apparatus of claim 29, wherein the second plurality of users include the first plurality of users.

31. An apparatus for increasing data transmission efficiency in a network, comprising:

means for identifying a viewing trend based upon monitored viewing activity of first content data by a first plurality of users over a unicast transmission link, wherein identifying the viewing trend comprises determining whether a total viewing time for the first content data being transmitted over the unicast transmission link satisfies a first threshold;

means for determining, based upon the identified trend, that a viewing audience will satisfy a second threshold for second content data; and means for, in response to the determination, broadcasting the second content data to a second plurality of users over a multicast transmission link.

32. The apparatus of claim 31, wherein the means for identifying the trend further comprises means for determining whether a number of the unicast transmission links exceeds a third threshold, the unicast transmission links being used to transmit the first content data.

33. The apparatus of claim 31, wherein the means for identifying the trend further comprises means for predicting the trend based on historical popularity data regarding the first content data.

34. The apparatus of claim 33, additionally comprising means for collecting the historical popularity data from sources outside of a broadcast network that includes the multicast transmission link.

35. The apparatus of claim 34, wherein the sources include at least one of the Internet, news mentions and blogging data.

36. The apparatus of claim 31, wherein the means for determining comprises means for identifying whether the second content data comprises a live event.

37. The apparatus of claim 31, wherein the means for determining comprises means for comparing at least one attribute of the first content data and the second content data.

38. The apparatus of claim 37, wherein the attribute comprises a genre.

39. The apparatus of claim 38, wherein the genre includes at least one of sports, news, entertainment and education.

40. The apparatus of claim 31, additionally comprising means for terminating broadcasting the second content data over the multicast transmission link if the second content data have been broadcast for a period of time, the period of time being determined based on the identified trend.

41. The apparatus of claim 31, additionally comprising means for terminating broadcasting the second content data over the multicast transmission link based upon monitored viewing activity of the second content data.

42. The apparatus of claim 31, wherein the first content data and the second content data are transmitted via the same content stream.

43. The apparatus of claim 42, additionally comprising means for continuing to transmit to the first plurality of users a portion of the content that follows the first content data in the same content stream.

44. The apparatus of claim 31, wherein the first content data and the second content data are transmitted via different content streams.

45. The apparatus of claim 44, wherein the second plurality of users include the first plurality of users.

46. A non-transitory computer-readable medium comprising instructions, which when executed by a processor, operate to increase data transmission efficiency in a network, the non-transitory computer-readable medium comprising:

instructions for identifying a viewing trend based upon monitored viewing activity of first content data by a first plurality of users over a unicast transmission link, wherein identifying the viewing trend comprises determining whether a total viewing time for the first content data being transmitted over the unicast transmission link satisfies a first threshold;

instructions for determining, based upon the identified trend, that a viewing audience will satisfy a second threshold for second content data; and instructions for broadcasting, in response to the determination, the second content data to a second plurality of users over a multicast transmission link.

47. The non-transitory computer-readable medium of claim 46, wherein the instructions for identifying the trend further comprise instructions for determining whether a number of the unicast transmission links exceeds a third threshold, the unicast transmission links being used to transmit the first content data.

48. The non-transitory computer-readable medium of claim 46, wherein the instructions for identifying the trend further comprise instructions for predicting the trend based on historical popularity data regarding the first content data.

49. The non-transitory computer-readable medium of claim 48, further comprising instructions for collecting the historical popularity data from sources outside of a broadcast network that includes the multicast transmission link.

50. The non-transitory computer-readable medium of claim 49, wherein the sources include at least one of the Internet, news mentions and blogging data.

51. The non-transitory computer-readable medium of claim 46, wherein the instructions for determining comprise instructions for identifying whether the second content data comprises a live event.

52. The non-transitory computer-readable medium of claim 46, wherein the instructions for determining comprise instructions for comparing at least one attribute of the first content data and the second content data.

53. The non-transitory computer-readable medium of claim 52, wherein the attribute comprises a genre.

54. The non-transitory computer-readable medium of claim 53, wherein the genre includes at least one of sports, news, entertainment and education.

55. The non-transitory computer-readable medium of claim 46, further comprising instructions for terminating broadcasting the second content data over the multicast transmission link if the second content data have been broadcast for a period of time, the period of time being determined based on the identified trend.

56. The non-transitory computer-readable medium of claim 46, further comprising instructions for terminating broadcasting the second content data over the multicast transmission link based upon monitored viewing activity of the second content data.

57. The non-transitory computer-readable medium of claim 46, wherein the first content data and the second content data are transmitted via the same content stream.

58. The non-transitory computer-readable medium of claim 57, further comprising instructions for continuing to transmit to the first plurality of users a portion of the content that follows the first content data in the same content stream.

59. The non-transitory computer-readable medium of claim 46, wherein the first content data and the second content data are transmitted via different content streams.

60. The non-transitory computer-readable medium of claim 59, wherein the second plurality of users include the first plurality of users.

* * * * *